United States Patent [19]

Patterson

[11] 4,266,782

[45] May 12, 1981

[54] HUNTING ARROW

[76] Inventor: Michael J. Patterson, 2279 Sodom-Hutchings Rd., Vienna, Ohio 44473

[21] Appl. No.: 136,887

[22] Filed: Apr. 3, 1980

[51] Int. Cl.[3] ..... F41B 5/02

[52] U.S. Cl. ..... 273/423; 273/421

[58] Field of Search ..... 273/419–423, 273/416

[56] References Cited

U.S. PATENT DOCUMENTS

| | | | |
|---|---|---|---|
| 2,212,345 | 8/1940 | Krieger | 273/420 |
| 2,277,743 | 3/1942 | Crossman | 273/423 |
| 2,891,794 | 6/1959 | Meyer | 273/423 |
| 3,881,730 | 5/1975 | Carella . | |
| 3,945,642 | 3/1976 | Henthorn, Jr. | 273/421 X |
| 4,020,740 | 3/1977 | Schirneker . | |
| 4,141,554 | 2/1979 | Sherwin | 273/421 X |
| 4,234,192 | 11/1980 | Salamone | 273/423 |

*Primary Examiner*—Paul E. Shapiro
*Attorney, Agent, or Firm*—Webster B. Harpman

[57] ABSTRACT

A hunting arrow has a shaft with a steel tip and a game penetrating two-part fletch. The first parts of the fletch are made of thin flexible razor sharpened steel that are in alignment with the remaining parts of the fletch which are usually flexible plastic or feathers. The razor sharpened steel parts of the fletch insure a large initial wound and faster kill.

6 Claims, 3 Drawing Figures

HUNTING ARROW

BACKGROUND OF THE INVENTION (1) Field of the Invention

This invention relates to hunting and game arrows of the type used with cross bows and the like.

(2) Description of the Prior Art

The prior art devices have used a variety of tips and fletch designs. See for example U.S. Pat. Nos. 2,212,345; 3,881,730 and 4,020,740.

In U.S. Pat. No. 2,212,345, an arrow head is disclosed wherein a spin is imparted to the arrow by the placement of the fletch and alignment of the arrow head.

U.S. Pat. No. 3,881,730 discloses an arrow head having a very unusual vane configuration for improved slight stability.

U.S. Pat. No. 4,020,740 discloses a projectile in FIGS. 20, 22 and 23 having what appears to be a metal fletch.

Applicant's device has a two-part fletch where the front portion is thin steel with razor sharp edges. The back portion of the fletch is plastic or feathers positioned as a continuation of the steel fletch having the necessary flexibility for good stable flight while providing additional kill power by increasing the diameter of the wound inflicted by the razor sharp steel fletch.

SUMMARY OF THE INVENTION

A hunting arrow having an improved game penetrating two-part fletch wherein the front portion is thin flexible steel with razor sharpened leading edges. The after part of the fletch is plastic or feathers for providing good flight characteristics in the arrow. The razor edges of the metal fletch result in a greater wound diameter for greater killing power and accuracy than a conventional game arrow.

DESCRIPTION OF THE PREFERRED EMBODIMENT

Figure 1:
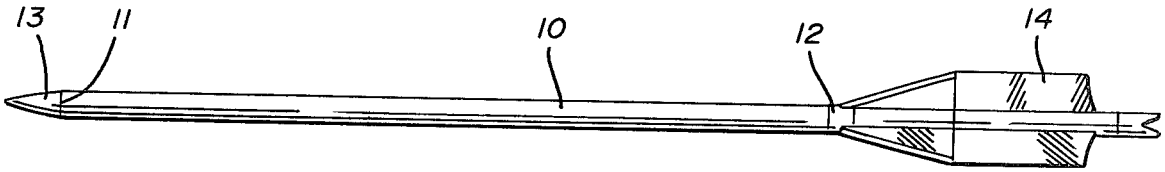
FIG. 1 is a side view of an arrow according to the invention.

A hunting arrow as seen in FIG. 1 of the drawings comprising a tubular shaft 10 with internally threaded ends 11 and 12 respectively.

Figure 2:
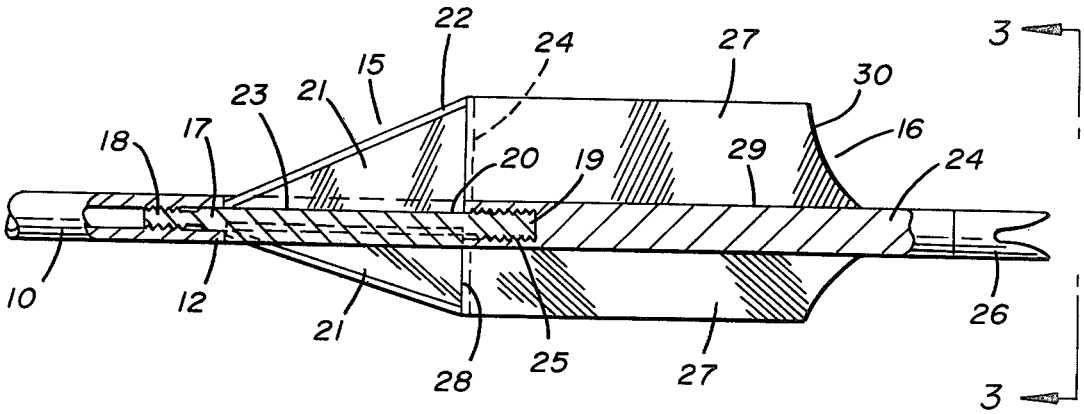
FIG. 2 is an enlarged side view, partially in section of the tail of an arrow according to the invention.
Figure 3:
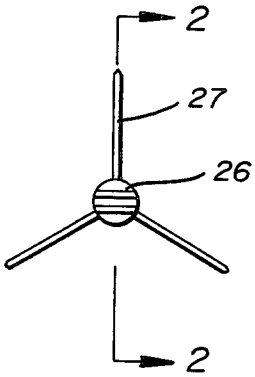
FIG. 3 is a rear view of an arrow according to the invention.

A tip 13 of the same diameter as the shaft 10 is secured to the end 11. A fletch assembly 14 consists of two portions 15 and 16 as will best be seen in FIGS. 2 and 3 of the drawings. The fletch portion 15 has an elongated solid body member 17 with oppositely disposed externally threaded ends 18 and 19 of reduced diameter and the body member 17 has a number of circumferentially spaced, longitudinally extending grooves 20 therein.

A plurality of thin flexible steel blades 21, having razor sharp leading edges 22, base edges 23 and trailing edges 24 form part of the arrows fletch. Each of the metal blades 21 is secured in one of the grooves 20 by its base edge 23 with the razor sharp leading edge 22 exposed. The fletch portion 15 is threadably secured to the end 12 of the shaft 10. The fletch portion 16 has a shaft 24 with an internally threaded end cavity 25 and a notched end 26. A number of thin flexible fins or vanes 27 are positioned in circumferentially spaced relation to each other on the shaft 24, the fins 27 each having a leading edge 28, a base 29 and a trailing edge 30 and are made from synthetic resin plastic material for durability and long life.

The fletch portion 16 is threadably secured to the end 19 of the fletch portions 15 and is aligned therewith by positioning the fins 27 in axial alignment with the thin steel blades 21.

Fin and blade alignment is maintained by inserting the trailing edge 24 of the blades 21 within the notched leading edges 28 of the fins 27.

In use, the hunting arrow has improved flight accuracy characteristics as compared with conventional game arrows and has substantially improved killing power due to the increased size of the wound inflicted on the animal by the razor sharp edges of the metal fletch portion 15. Flight accuracy is improved as compared with conventional game arrows in that there are no large blades on the tip of the arrow to act as air deflecting vanes.

It will thus be seen that a new and improved hunting arrow has been illustrated and described and it will be apparent to those skilled in the art that various changes and modifications may be made therein without departing from the spirit of the invention and the scope of the appended claims, and having thus described my invention what I claim is:

1. A hunting arrow comprising a shaft, a tip on one end of said shaft and a circumferentially spaced fletch inwardly of the other end of said shaft, a notch in said other end of said shaft, said fletch comprising several angular shaped thin steel members, each having a razor sharpened leading edge, said leading edge disposed at an angle from said shaft and several flexible, thin, generally rectangular secondary members, each in axial alignment with said thin steel members and in abutment therewith.

2. The hunting arrow of claim 1 and wherein said angular shaped thin steel members and said rectangular secondary members are partially embedded in said shaft.

3. The hunting arrow of claim 1 and wherein said shaft is formed in at least two parts in end to end engagement and the angular shaped thin steel members are affixed to one of said parts and extend outwardly radially therefrom.

4. The hunting arrow of claim 3 and wherein the shaft is formed of three parts and the angular shaped thin steel members are affixed to the middle one of said three parts and the shaft parts are detachably engaged to one another.

5. The hunting arrow of claim 4 and wherein the three parts of said shaft are provided with registering threaded patterns to form said detachable attachments.

6. The hunting arrow of claim 1 and wherein said rectangular secondary members are formed of synthetic resin.

* * * * *